US005117927A

United States Patent [19]

Askew

[11] Patent Number: 5,117,927

[45] Date of Patent: Jun. 2, 1992

[54] DOWNHOLE ADJUSTABLE BENT ASSEMBLIES

[75] Inventor: Warren E. Askew, Houston, Tex.

[73] Assignee: Anadrill, Sugar Land, Tex.

[21] Appl. No.: 649,107

[22] Filed: Feb. 1, 1991

[51] Int. Cl.[5] ..... E21B 7/08

[52] U.S. Cl. ..... 175/61; 175/74; 175/325.2

[58] Field of Search ..... 175/61, 73, 74, 325, 175/256

[56] References Cited

U.S. PATENT DOCUMENTS

| | | | |
|---|---|---|---|
| 2,194,267 | 3/1940 | Brock et al. . | |
| 3,068,946 | 12/1962 | Frisby et al. . | |
| 3,190,374 | 6/1965 | Caperan et al. . | |
| 3,196,959 | 7/1965 | Kammerer . | |
| 3,398,804 | 8/1968 | Holbert . | |
| 3,457,999 | 7/1969 | Massey . | |
| 3,563,323 | 2/1971 | Edgecombe . | |
| 3,586,116 | 6/1971 | Tiraspolsky et al. . | |
| 3,667,556 | 6/1972 | Henderson . | |
| 4,067,404 | 1/1978 | Crase . | |
| 4,076,084 | 2/1978 | Tighe . | |
| 4,077,657 | 3/1978 | Trzeciak . | |
| 4,220,214 | 9/1980 | Benoit | 175/61 |
| 4,286,676 | 9/1981 | Nguyen et al. . | |
| 4,442,908 | 4/1984 | Steenbock . | |
| 4,492,276 | 1/1985 | Kamp . | |
| 4,508,182 | 4/1985 | Anders . | |
| 4,522,272 | 6/1985 | Beimgraben . | |
| 4,596,294 | 6/1986 | Russell . | |
| 4,597,454 | 7/1986 | Schoeffler . | |
| 4,629,012 | 12/1986 | Schuh . | |
| 4,641,717 | 2/1987 | Eppink | 175/256 X |
| 4,653,598 | 3/1987 | Schuh et al. . | |
| 4,655,289 | 4/1987 | Schoeffler . | |
| 4,655,299 | 4/1987 | Schoeffler . | |
| 4,667,751 | 5/1987 | Geczy et al. | 175/61 |
| 4,694,914 | 9/1987 | Obrecht | 175/61 |
| 4,739,842 | 4/1988 | Kruger et al. . | |
| 4,745,982 | 5/1988 | Wenzel . | |
| 4,811,798 | 3/1989 | Falgout, Sr. et al. . | |
| 4,813,497 | 3/1989 | Wenzel . | |
| 4,817,740 | 4/1989 | Beimgraben . | |
| 4,834,196 | 5/1989 | Falgout, Sr. . | |
| 4,836,303 | 6/1989 | Boulet et al. | 175/74 |
| 4,858,705 | 8/1989 | Thiery . | |
| 4,880,066 | 11/1989 | Steiginga et al. . | |
| 4,880,067 | 11/1989 | Jelsma . | |
| 4,884,643 | 12/1989 | Wawrzynowski et al. | 175/325 X |
| 4,895,214 | 1/1990 | Schoeffler . | |
| 4,932,482 | 6/1990 | DeLucia . | |
| 5,050,692 | 9/1991 | Beimgraben . | |

OTHER PUBLICATIONS

Boulet, J. G., "THD System/Telepilote/Varistab", SMF International Article, Ocean Industry/OTC 1986.

"Mechanical Telepilote—The New Tool to Stay on Tartet", SMF International (no date).

H. Karlsson et al., "Performance Drilling Optimization", SPE Paper No. 13474, Mar. 6-8, 1985, New Orleans, La.

"Horizontal Systems Growing More Specialized", Directional Control Technologies, Offshore, pp. 36-43, Oct. 1989.

*Primary Examiner*—William P. Neuder

*Attorney, Agent, or Firm*—David L. Moseley; John J. Ryberg

[57] ABSTRACT

In accordance with an illustrative embodiment of the present invention, a downhole adjustable apparatus for creating a bend angle in a drill string includes a mandrel mounted for rotation between first and second angular positions within a housing, the mandrel being telescoped into the housing on an axis that is inclined with respect to the principle axial centerline of the housing, so that in one rotational position of the mandrel the housing is axially aligned with the centerline of a drilling motor and in another rotational position that is 180° from the initial position the housing is slightly inclined with respect to the centerline of such drilling motor to establish a bend angle. Further manipulation of the mandrel is used to return the members to their original positions for straight-ahead drilling.

34 Claims, 4 Drawing Sheets

DOWNHOLE ADJUSTABLE BENT ASSEMBLIES

FIELD OF THE INVENTION

This invention relates generally to a bent housing or sub for use in changing the direction in which a borehole is being drilled, and particularly to a new and improved bent housing or sub apparatus that is adjustable downhole to cause the bit to either drill straight ahead or along a curved path.

BACKGROUND OF THE INVENTION

In order to change the inclination in which a borehole is being drilled, it has been a common practice to place in the downhole assembly a so-called "bent sub" which is a special piece of pipe that is made with a small bend angle between upper and lower portions thereof. The bent sub usually is connected to the top of the downhole motor which drives the bit in response to circulation of drilling fluids, or it can be a part of the assembly between the motor and its bearing section. The presence of a bend angle causes a gradual change in the inclination of the bottom portion of the borehole as the bit drills ahead, with the result that the borehole is formed along a curved path until a desired new inclination is achieved. The presence of a bend angle also allows torque that is applied to the drill string at the surface to be used to steer the bit to the right or to the left to achieve a change in the azimuth of the borehole. However, when the conventional type of bent sub is used, the drill string must be removed from the well in order to position the bent sub in, or take it out of, the downhole assembly.

The round trips of the drill pipe are necessary to insert and remove the typical bent sub are time consuming and very costly. There has been a long-felt need for a workable bent apparatus that is constructed in a manner such that a bend angle can be established in the tool downhole to enable a change in hole inclination to be accomplished when the need arises, and the bend angle eliminated downhole when straight-ahead drilling is desired. This need has become acute because of multiple well bores that are drilled from a single platform, and as horizontal drilling practices have come into common usage as a means for increasing the productivity of wells.

Bent sub assemblies that have an adjustable bend angle have been proposed, but are not considered to be commercially practical for various reasons. For example, devices such as those shown in U.S. Pat. Nos. 4,745,982, 4,813,497, 4,836,303, 4,220,214, 4,240,512, and 4,303,135 have to be removed from the well for adjustment of the bend angle, which necessitates a time consuming and expensive round trip of the drill string. Another adjustable bent sub which is described in U.S. Pat. No. 4,077,657, also must be hoisted up to the surface for adjustment. Proposals for downhole adjustable bent subs are shown in U.S. Pat. Nos. 4,655,299, 4,895,214 and 4,596,294, however these systems require surface manipulation of flow rates of the drilling fluids to achieve different downhole states of the bent sub. Since most wells, or sections thereof, are drilled using an optimum mud flow rate, particularly where a downhole motor is being used, changes in such flow rate are undesirable because they can affect the performance of the motor. Others downhole adjustable systems are illustrated in U.S. Pat. Nos. 4,884,643 and 4,374,547, however these devices include ratchets and continuous jay slots and pin arrangements which are mechanically complex and not particularly sturdy.

The general object of the present invention is to provide a new and improved bent sub assembly that can be adjusted downhole to control the bend angle without removing the drill pipe from the well.

Another object of the present invention is to provide a new and improved bent assembly that can be operated downhole to cause straight-ahead drilling, or adjusted to effect a change in the well bore inclination.

Another object of the present invention is to provide a new and improved bent housing apparatus that can be operated downhole so as to change its configuration from one where a lower portion thereof is coaxial with the longitudinal axis of the drilling motor for straight-ahead drilling, and another where such lower portion is at an angle with respect to such longitudinal axis for drilling a curved borehole.

Still another object of the present invention is to provide new and improved methods of controlling the bend angle of a downhole adjustable bent apparatus.

SUMMARY OF THE INVENTION

These and other objects are attained in accordance with the concepts of the present invention through the provision of an bent sub apparatus comprising an upper inner member and a lower outer member, with a lower section of said upper member being telescopically disposed with respect to an upper section of said lower member. The lower section of said upper member has an axis that is inclined at a small angle with respect to the axis of the upper portion thereof, and such lower section extends down into the upper section of the lower member which has a bore axis that is inclined at the same angle as said lower section. When said lower and upper sections are rotated relative to one another, such angles are additive so that at a first relative position the angles cancel one another and the assembly is essentially straight. At a second relative position that is at 180° to the first relative position the bend angle is twice such angle. When the members are rotated back to the original or 0° reference position, the bend angle disappears by cancellation.

Relative rotation is achieved downhole by stopping the pumps to release a hydraulic lock, and them lowering the pipe string to release a clutch. Then the pipe string is rotated slowly to the right to cause the upper member to rotate relative to the lower member until a stop engages, at which point preferably about 180° of relative rotation will have occurred to establish a bend angle, for example, of 1°. Other angles can be established, depending upon the geometry of the tool. Then the upper member is raised, and the mud pumps restarted to operate the downhole motor and reengage the hydraulic lock. The bit now tends to drill at a different inclination, and will gradually drill along a curved path so long as the bend angle is present. To remove the bend angle so that further drilling will be straight-ahead, the same procedure is employed to rotate the upper member on around to its initial, or zero, position where the lower section of the lower member is realigned with the longitudinal axis of the drilling motor.

BRIEF DESCRIPTION OF THE DRAWINGS

The present invention has other objects, features and advantages that will become more clearly apparent in connection with the following detailed description of preferred embodiments, taken in conjunction with the appended drawings in which.

DETAILED DESCRIPTION OF A PREFERRED EMBODIMENT

Figure 1:
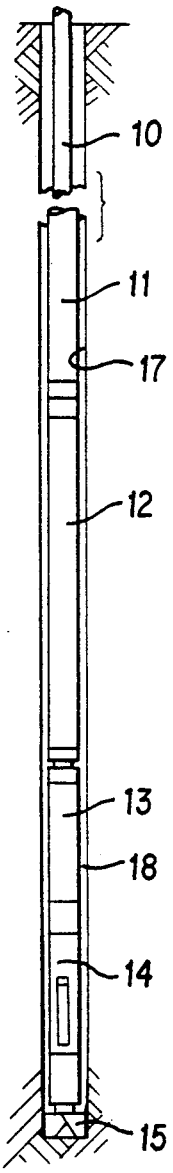
FIG. 1 is a schematic view of a downhole tool assembly that includes the bent housing apparatus of the present invention.

Referring initially to FIG. 1, a drill string including a section of drill pipe 10 and length of drill collars 11, a downhole motor power section 12, the bent housing assembly 13 of the present invention, a radial and thrust bearing section 14, and a drill bit 15 are shown disposed in a borehole 17. Drilling fluids that are circulated by mud pumps at the surface down the pipe 10 and the collars 11 cause the rotor of the power section 12 to spin, and such rotation is coupled to the drill bit 15 by a drive shaft having cardan-type universal joints at each end. The drilling fluids are exhausted through nozzles, or jets, in the bit 15, and circulate upward toward the surface through the annulus 18. Several stabilizers can be included in the drill string at longitudinally spaced points to provide a desired configuration of the downhole assembly, however only one stabilizer 19 on the bearing assembly 14 is shown for convenience of illustration. As will be apparent from the detailed description that follows, the bent housing assembly 13 can be adjusted downhole from one condition where the drill bit 15 will drill straight ahead, which in the example illustrated in FIG. 1 can be vertically downward, to another condition where the bit will drill along a curved path in order to establish a different borehole inclination. Then the assembly 13 can be adjusted back to its original configuration where the bit 15 again will drill straight-ahead, but at such different inclination. With a bend angle present, the bit can be steered to a different azimuth by applying and holding torque on the drill string.

Figure 2A:
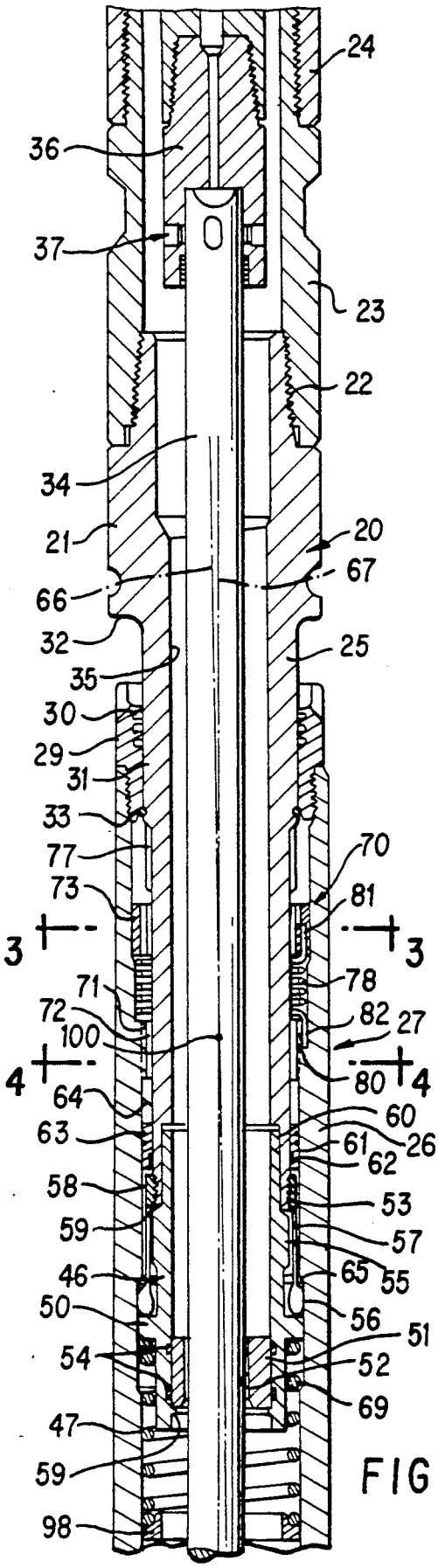
FIGS. 2A and 2B are longitudinal cross-sectional views of the present invention in its straight ahead position, FIG. 2B forming a lower continuation of FIG. 2A.
Figure 2B:
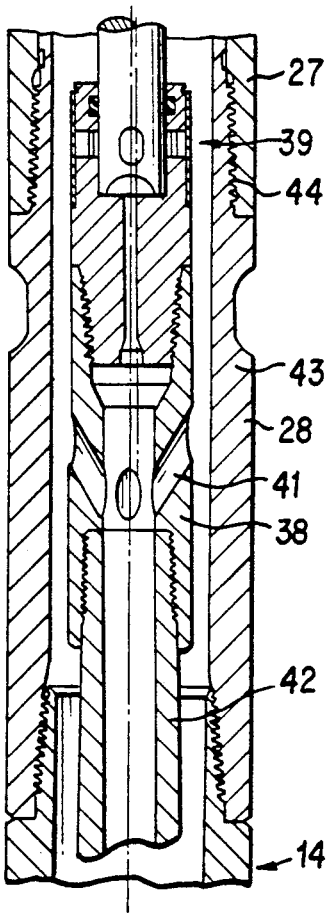

Referring now to FIGS. 2A and 2B, the bent housing assembly 13 includes a mandrel 20 having an enlarged diameter upper section 21 that is connected by threads 22 to the lower sub 23 of the drilling motor housing 24. The longitudinal centerline of the upper section 21 is coaxial with the centerline of the motor housing 24. The lower section 25 of the mandrel 20 extends into the upper section 26 of a tubular housing 27. The section 25 is inclined at a small angle, for example ½°, with respect to the longitudinal axis of the upper section 21 and the motor housing 24. In like manner, the internal bore of the upper section 26 of the housing 27 is inclined at the same small angle with respect to the longitudinal axis of the lower section 28 thereof. However, the lower section 28 of the housing 27 has a central axis that is aligned with the central axis of the mandrel section 21.

A top collar 29 that is threaded to the upper housing section 26 carries seal rings 30 that engage the outer surface 31 of the mandrel section 25 to prevent fluid leakage. Initially the upper end of the collar 29 is spaced below the lower surface 32 of the mandrel section 21 so that the mandrel 20 and housing 27 are extended relative to one another. A retainer ring 33 engages a downwardly facing shoulder on the collar 29 to limit upward relative movement.

A drive shaft 34 that extends down through the bore 35 of the mandrel 20 has its upper end coupled to the output shaft adaptor 36 of the motor 12 by a universal joint assembly 37. The U-joint assembly 37 is conventional and need not be described in detail. The lower end of the shaft 34 likewise is coupled by a U-joint 39 (FIG. 2B) to a port sub 38 which has flow ports 41 so that drilling fluids which pass through the annular space between the drive shaft 34 and the bore 35 of the mandrel 20 and between the drive shaft and the inner wall of the lower sub 28 of the housing 27, enter a flow tube 42 via the ports 41 and flow on down toward the bit 15. The lower sub 43 of the housing 27 is threaded thereto at 44, and connects the housing to the bearing section 14 (not shown) which accommodates the radial as well as axial thrust loads as the bit 15 drills on bottom.

Figure 5:
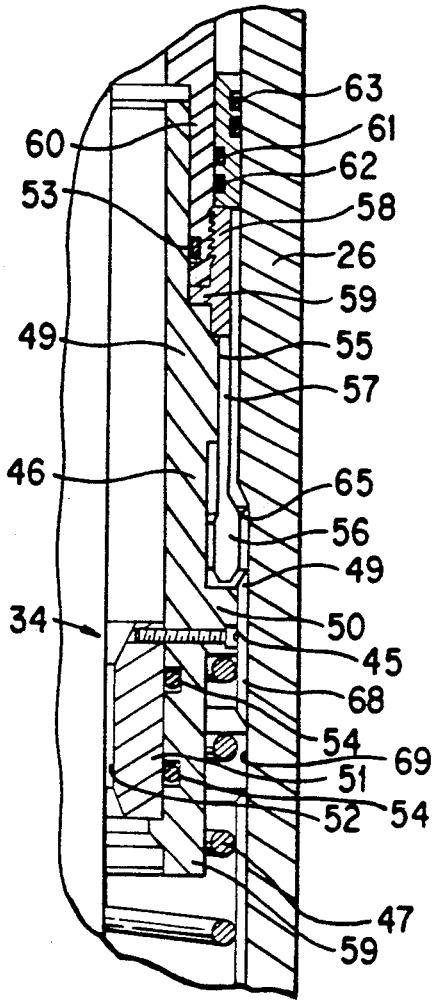
FIG. 5 is an enlarged, fragmentary view of the pressure responsive latch mechanism that locks the members in extended position.

As shown in FIG. 2A and in enlarged detail in FIG. 5, a sleeve 46 that is mounted at the lower end portion of the mandrel 20 is biased upward by a coil spring 47 which reacts between a support ring 48 which is fixed to the housing 27, and the lower surfaces of an outwardly directed spider 50 on the sleeve 46. The sleeve 46 carries an annular orifice member 51 having a throat 52 through which the drilling fluids pass as they are pumped downward. The orifice member 51 is fixed against rotation relative to the sleeve 46 by a set screw 45, and against downward movement by a shoulder 59 on the lower end of the sleeve. the sleeve 46 is fixed against rotation relative to the mandrel 20 by an outwardly directed lug 49 on one leg of the spider 50 that slides in a longitudinal groove 68 in the inner wall of the housing 20. The spider 50 can have longitudinal flow slots between its legs. The central axis of the throat 52 of the member 51 is eccentrically arranged so as to coincide with the median axial position of the drive shaft 34. A seal ring 53 prevents leakage of the drilling fluids to the outside, and seal rings 54 prevent leakage past the outer diameter of the orifice member 51.

The pressure drop across the orifice member 51 produces downward force that shifts the sleeve 46 downward against the bias of the spring 47 so that an annular locking surface 55 thereon is positioned behind the enlarged heads 56 on the lower ends of a plurality of circumferentially spaced spring fingers 57. The spring fingers 57 extend downward from a collar 58 that is threaded to the lower portion 60 of the mandrel 20. The heads 56 are arranged to engage in an internal annular groove 65 in the housing 27 when the mandrel 20 is extended, and function to releasably lock the mandrel 20 and the housing 27 in such extended position so long as the locking surface 55 is behind the heads. Another internal annular recess 69 is formed in the wall of the housing 27 below the recess 56, and receives the heads 56 in the retracted position of the mandrel 20 to enable free relative rotation. A compensating piston 61 having inner and outer seal rings 62, 63 can move between the mandrel portion 60 and the inner wall surface 64 of the housing 27. The interior region between the mandrel 20 to the housing 27 from the upper cap 29 to the piston 61 is filled with a suitable lubricating oil, and the piston provides compensation for changes in internal pressure and in temperature.

Figure 6:
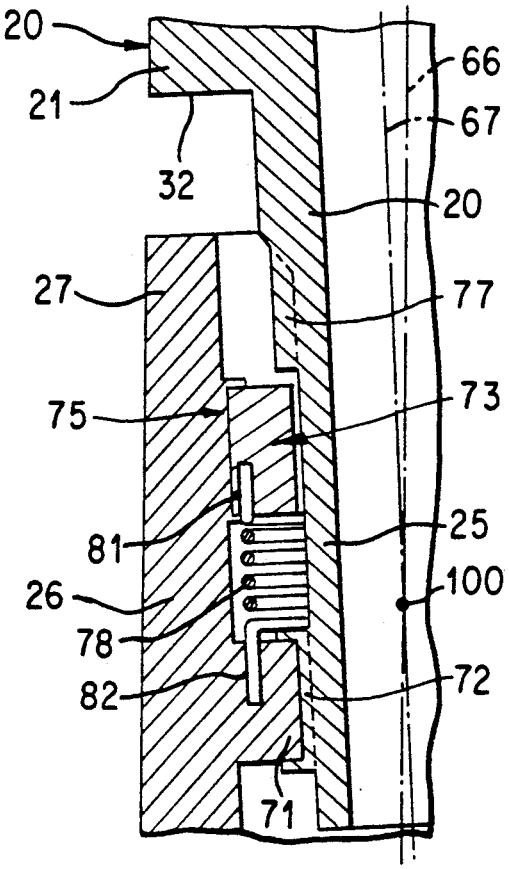
FIGS. 6-8 are left side only, schematic, cross-sectional views to further illustrate the overall method of operation of the present invention.

As shown by a dash line in FIG. 6, the longitudinal centerline 67 of the lower section 25 of the mandrel 20 does not coincide with the longitudinal centerline 66 of the lower section 28 of the housing 27. This centerline, shown as long and short dash lines, lines up with the axial centerlines of the drilling motor 12 and the bit 15 when the apparatus 13 is in its straight configuration. Thus arranged, the transverse thickness of the various parts of the housing 27 in the sectional plane of the right hand side of the drawing FIG. 2A are gradually reduced with respect to the corresponding thicknesses of these parts in the sectional plane of the left hand side of the drawings, as a transverse cross-section of such thicknesses is moved progressively downward. In other words the various machined surfaces within the upper housing section 26 are arranged on the inclined centerline 67 as their reference axis, as are the external machined surfaces of the lower sections 25 of the mandrel 20. Thus when the bent housing assembly 13 is in its straight condition, the outer diameters of the mandrel, housing and motor are all in-line.

Figure 3:
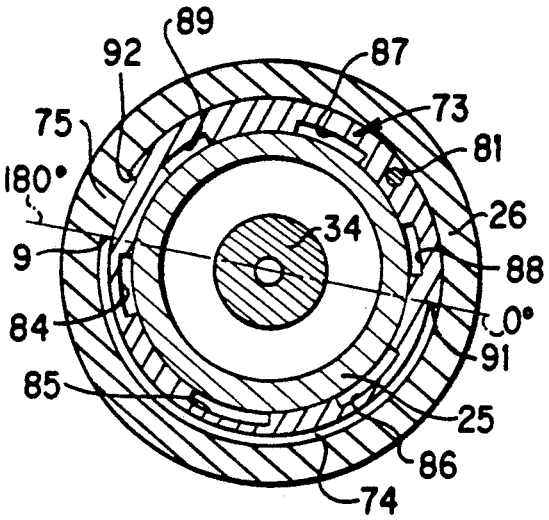
FIGS. 3 and 4 are cross-sections on lines 3—3 and 4—4 of FIG. 2A.
Figure 4:
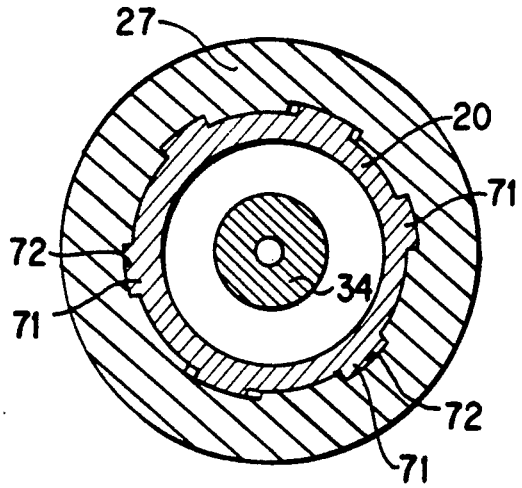

As shown in FIGS. 2A, 3 and 4, the bent housing apparatus 13 is equipped with a control system indicated generally at 70 that includes companion locking splines 71 and 72 on the mandrel 20 and the housing 27 respectively. These splines are engaged when the mandrel 20 is extended relative to the housing 27 to prevent relative rotation in that position. A rotational stop means includes a stop ring 73 having an external arcuate recess 74 that is engaged by an internal spline rib 75 on the housing 27, and a plurality of internal spline grooves that mesh with actuator splines 77 ( FIG. 2A) on the mandrel 20 when it is moved downward to disengage the locking splines 71, 72. A relatively heavy, coiled torsion spring 78 has a lower tang 82 that is received in a hole in an inwardly directed shoulder 80 on the housing 27, and an upper tang 81 that engages in a hole 74 in the stop ring 73. The coil spring 78 tends to maintain the stop ring 73 in its initial angular orientation with respect to the housing 27 where a vertical shoulder 92 at one end of the recess 74 engages the spline rib 75 as shown in FIG. 3. Preferably the spring 78 has an initial preload or wind-up to ensure return to its initial position.

As shown in FIG. 3, the spline grooves inside the stop ring 73 include four grooves 84–87 of the same width, and two grooves 88, 89 that are both narrower than the grooves 84–87. The spline ribs 77 on the mandrel 20 have the same arrangement of widths. Thus, the mandrel splines 77 can engage the ring grooves 85–89 in only one rotational orientation. The external recess 74 reduces the outer diameter of the ring 73 through an angle of 200°, for example, between a vertical shoulder 91 at the other end of the recess and the previously mentioned shoulder 92. With this arrangement, the ring 73 can be rotated in a clock-wise direction by the mandrel 20 relative to the housing 27 only until the shoulder 91 abuts a shoulder 93 on the rib 75, at which point the mandrel will have rotated exactly 180° relative to the housing. During such relative rotation, the torsion spring 78 is wound up, so to speak, and thus applies increased torque that tends to rotate the ring 73 back to its original position shown in FIG. 3. When the splines 77 on the mandrel 20 are withdrawn from the grooves by extension of the mandrel, the spring 78 automatically repositions the ring 73 to the orientation shown in FIG. 3.

Figure 7:
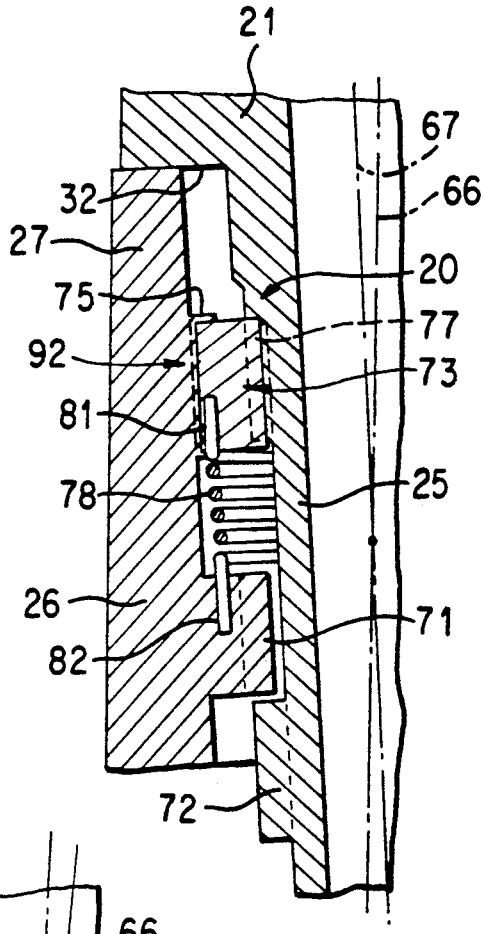

The "straight ahead" relative position for the mandrel 20, the housing 27, and the control system 70 including the stop ring 73 is shown schematically in FIG. 7. The mandrel 20 is shown in the extended position relative to the housing 27, so that the shoulder 32 is spaced above the upper end surfaces of the housing. The clutch splines 71, 72 are engaged to prevent relative rotation, which locks the mandrel 20 within the housing 27 at a 0° angular reference position. At this reference position the rotation axis of the bit 15 is aligned with the longitudinal axis of the drilling motor 12, so that drilling will proceed straight ahead.

Figure 8:
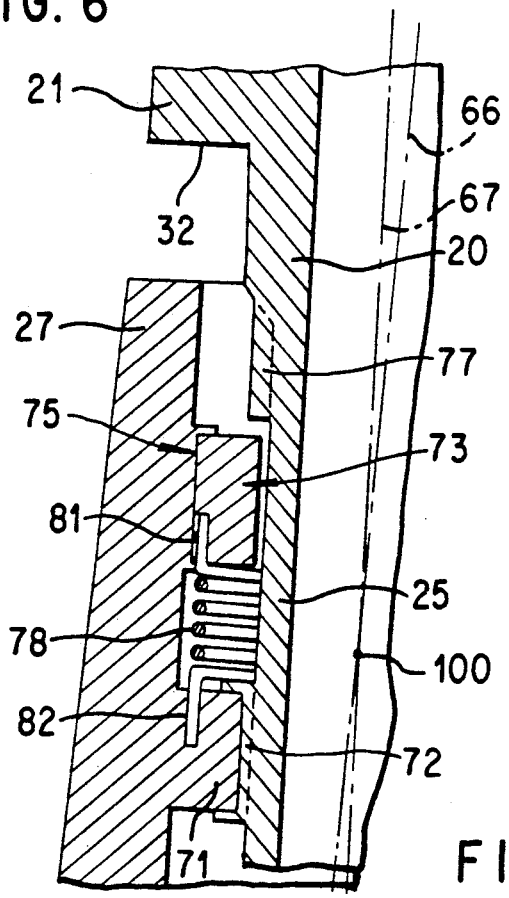

In order to adjust the bent housing assembly 13 downhole to produce a bend angle, pumping of drilling fluids is momentarily stopped so that there no longer is any pressure drop across the orifice member 51. The coil spring 47 (FIG. 5) then shifts the locking sleeve 46 upward to remove the locking surface 55 from behind the heads 56, which are then released so that they can be cammed inward and out of the recess 56. Then the mandrel 20 is lowered within the housing 27 to the contracted position where the surface 32 engages the top of the housing 27, as shown schematically in FIG. 7. The clutch splines 71, 72 are disengaged, and the actuator splines 77 on the mandrel 20 mesh with the inner grooves 84–89 of the stop ring 73. The mandrel 20 and the stop ring 73 then are rotated relative to the housing 27 through an angle of 180°, at which point the side face 91 at one end of the recess 74 abuts the opposed side face 93 of the housing rib 75. Such relative rotation causes the inclined longitudinal axis 67 of the mandrel section 25 to swing through an hourglass-like arc about the crossing point 100 to the orientation shown in dash lines in FIG. 8. This motion of the mandrel section 25 causes the lower end of the housing 27 to shift over with respect to the axis 66 of the motor 1 through a predetermined bend angle. This angle can be, for example, 1° although it could be any value usually in the range of about ½°–3° to cover a wide variety of directional drilling applications. Then as shown in FIG. 8, the mandrel 20 is raised to reengage the clutch splines 70, 71 and to disengage the actuator splines 77 from the stop ring 73. As the mandrel splines 77 are pulled out of the stop ring 73, the torsion spring 78 rotates the ring counter-clockwise to its initial or reference position shown in FIG. 3. When pumping again is started, the pressure drop across the orifice member 51 produces a force that shifts the sleeve 46 downward to where the external locking surface 55 thereon again is behind the heads 56 to lock them in the internal recess 65, and thereby lock the mandrel 20 and the housing 27 against relative longitudinal movement.

As mentioned above, rotation of the mandrel 20 relative to the housing 27 produces a shift or pivot of the principle longitudinal axis 66 of the housing by 1° with respect to the longitudinal axis of the power section 12 of the drilling motor. With a 1° bend in the assembly 13 between the motor 12 and the bearing section 14, the face of the bit 15 also is inclined by 1° with respect to a transverse plane at a right angle to the axis 66. Thus the bit 15 will tend to drill along a curved path that lies in a plane which contains the axes 66 and 67 in their orientation shown in FIG. 8.

To return the bent housing asembly 13 to its initial, straight ahead position, pumping is stopped to enable the spring 47 to shift the sleeve 46 upward and unlock the heads 56 on the spring fingers 57 so that they can be pushed out of the housing recess 65. The mandrel 20 is lowered with respect to the housing 27 to disengage the clutch splines 71, 72 and to engage the actuator splines 77 with the stop ring 73. The torsion spring 78 will have returned the stop ring 73 to its initial position when the mandrel 20 was previously raised. With the splines 71, 72 disengaged, the mandrel 20 again is rotated clockwise through 180° until the shoulders 91 and 93 engage to stop rotation at the 180° position, at which point the mandrel will have returned to its initial rotational position relative to the housing 27. As this occurs, the principle axis 66 of the housing 27 is returned to the orientation where it is in line with the longitudinal axis of the drilling motor 12, so that further drilling will be straight ahead. When the mud pumps are restarted, the pressure drop across the orifice member 51 results in locking the mandrel 20 in its upper position relative to the housing 27, as described above.

OPERATION

The bent housing 13 is assembled as shown in FIGS. 2A and 2B, and the upper end of the mandrel 20 is connected to the box connection 23 on the lower end the housing 24 of the power section of the drilling motor 12. The adapter 36 for the drive shaft 34 will have been made up to the lower end of the rotor shaft of the motor 12, and the universal joint 37 allows orbital movement of the lower end of such shaft, which is typical of moyno-type devices. The lower universal joint 39 connects the drive shaft 34 to the adapter 38 by which drilling fluids enter the bore of the drive tube 42 and pass downward through it to the bit 15. The drive tube 42 is centrally arranged within the bearing section 14 that is connected by threads to the housing 28. After the drill bit 15 is made up on the lower end of the bearing section 14, the string of drilling tools, including stabilizers fixed at desired points therein, is lowered into the wellbore 17 on the drill string. When the bit 15 reaches a level that is just off bottom, the pumps are started to circulate drilling fluid down the drill string to operate the motor 12 and turn the bit 15. The bit 15 is then lowered to bottom, and a selected amount of weight of the drill string is slacked off on the bit to cause efficient drilling. The drilling fluid, or mud, passes out through the bit nozzles and into the annulus 18 where it circulates upward and carries cuttings to the surface.

The apparatus 13 typically will be conditioned initially for straight-ahead drilling, that is, the condition shown in FIGS. 2A, 2B and 6 where the reference angle between the mandrel 20 and the housing 27 is zero degrees. In this relative rotational position, the principle axis 66 of the lower housing section 28 is aligned with the longitudinal axis of the motor 12, so that the assembly is essentially a straight column, and there are no side thrust forces tending to cause the bit 15 to drill along a curved path. The splines 71 on the mandrel 20 are meshed with the splines 72 on the housing 27 to prevent relative rotation. After the mud pumps are started to initiate circulation, the pressure drop across the orifice ring 51 produces downward force that compresses the coil spring 47 and shifts the locking surface 55 on the sleeve 46 behind the latch heads 56. This locks the mandrel 20 and the housing 27 against longitudinal relative movement. The drive shaft 34 rotates eccentrically within the throat 52 of the orifice ring 48, but with lateral clearance as shown in FIG. 2A due to the offset of the throat 52.

When it is necessary or desirable to change the path of the bottom portion of the borehole 17, the pumps are stopped momentarily. The coil spring 47 shifts the sleeve 46 to its upper, unlocked position, and the mandrel 20 is lowered within the housing 27 to disengage the clutch splines 70, 71, and then turned to the right. As the mandrel 20 moves downward, the upper splines 77 engage the internal grooves 84–89 on the stop ring 73, so that the ring must rotate with the mandrel 20. The stop shoulder 91 on the ring 73 engages the shoulder 93 on the housing 27 at the end of 180° of rotation. During such relative rotation, the longitudinal axis of the lower section 28 of the housing 20 is skewed from its original position by substantially 1°. Then the mandrel 20 is raised upward to withdraw the upper splines 77 from the stop ring 73, and to reengage the clutch splines 71, 72. When the upper splines 77 clear the stop ring 73, the torsion spring 78 rotates the stop ring back to its initial position relative to the housing 27, so that the process can be repeated to realign the principle axis of the housing section 28 with the drilling motor axis when needed. When the pumps are restarted, the sleeve 46 shifts down again to lock the mandrel 20 to the housing 27 in the extended relative position.

With the bent housing assembly 13 providing a 1° bend angle, the weight-on-bit produces a lateral force component which causes the bit 15 to drill along a curved path. To drill to the right or to the left of this plane (whose bearing is the "tool face" angle) rotation can be applied to the drill string at the surface. When straight ahead drilling is to be resumed, the pumps are stopped momentarily to unlock the mandrel 20 from the housing 27. Then the mandrel 20 is lowered as before, rotated 180° until the stop ring shoulder 91 engages the housing shoulder 93 at the 180° reference position, and then raised to reengage the splines 71, 72. During these manipulations, the principle axis the lower housing section 28 is realigned with the axial centerline of the upper mandrel section 21 so that straight-ahead drilling occurs when the mud pumps are restarted. When the mandrel 20 is raised or extended, the stop ring 73 again is rotated by the spring 78 to its initial orientation where its shoulder 92 engages the rib 75.

It now will be apparent that the telescoping portions of the mandrel 20 and the housing 27 are constructed such that as the mandrel is rotated relative to the housing from an initial 0° reference position one half turn to a second position, the points where the lower end of the axis 67 of the mandrel intersect a plane that is at a right angle to the axis 66 describe a circle having the zero reference position as a starting point. The axial centerlines of the lower housing section 68 and the upper mandrel section 21 are in-line at the 0° reference position because the angles between the axis 67 of mandrel portion 25 and the axial centerline of the lower housing section 28 and such axis, cancel one another. The maximum excursion of the axial centerline of the lower housing section 28 occurs at 180° of relative rotation, where it is inclined at the sum of the values of the previously-mentioned angles. For example, where these angles are ½°, the bend angle will be 1°. This particular bend angle is suitable for many directional drilling applications. Of course other bent angles can be achieved by changing the angle between the centerline 67 of the lower mandrel section 25 and the principle longitudinal axis 66 of the mandrel 20, with corresponding changes in the internal surfaces of the housing bore. The centerlines could also be at different angles to go from an initial minimum bend angle at the 0° reference position to a greater bend angle at 180° of rotation.

To assure that the appartus 13 will be in its extended position when the mud pumps are turned off, and to prevent release of stored torque when the locking splines 71, 72 disengage, it may be desirable to pick the bit 15 up off bottom before setting down to rotate the mandrel 20. As weight is set down, internal friction is overcome and the heads 56 on the locking fingers 57 are cammed inward to their released positions. The mandrel goes to its completely retracted position when the mandrel shoulder 32 rests on the top of the housing as shown in FIG. 6. With the splines 71, 72 disengaged, and the stop ring splines 85–89 engaged, the mandrel 20 is rotated 180° relative to the housing. During such rotation, the mud motor 12 is, in effect, rotated backwards and will pump mud upward from the bit 15. This action is helpful in creating drag in the bearings to allow the mandrel 20, and not the housing 27, to rotate. Of course much of the drag may come from the stabilizer 19 (FIG. 1) on the bearing assembly 14 having at least one of its blades dragging against the well bore wall. Inertial effects also come into play.

It also will be recognized that there is a fairly large extension force on the mandrel 20 due to the pressure drop across the bit 15. This extension force tends to keep the mandrel 20 in the upper position, in addition to the coupling force of the locking fingers 57. The locking fingers 57 can be included to prevent downward mandrel travel only when the weight-on-bit exceeds the hydraulic extension force. It is possible to eliminate the locking fingers 57 to shorten the overall length of the assembly 13 if the hydraulic extension force can be relied upon solely to prevent downward mandrel travel while drilling. Higher bend angles also would be possible with a shorter assembly.

In case the mandrel 20 is not rotated through a full 180° to actuate the tool, of course the clutch splines 71, 72 will not engage. If this should occur, the drill pipe can be rotated slowly at the surface while operating the mud pumps slowly, and setting some weight down on the bit 15. This procedure will rotate the mandrel 20 on around to where the splines 71, 72 will engage due to the hydraulic extension force.

The crossing point of the axes 66 and 67 has been illustrated as being at point 100 in the region of the clutch splines 71, 72. Although the point 100 could be located at other vertical levels in the housing 27 and still achieve a bend angle in response to relative rotation, this particular location for the crossing point is believed to be a good choice in view of all relevant factors.

Although a device having a predetermined bend angle at 180° of relative rotation has been disclosed, it should also be apparent that the shoulder 93 could be formed at some lesser angle with respect to the stop surface 91 on the ring 73, for example 90°. In this case, a lesser bend angle would be established at the 90° position, and the maximum bend angle established at the 180° position. All such variations are considered to be within the scope of the present invention.

Figure 9:
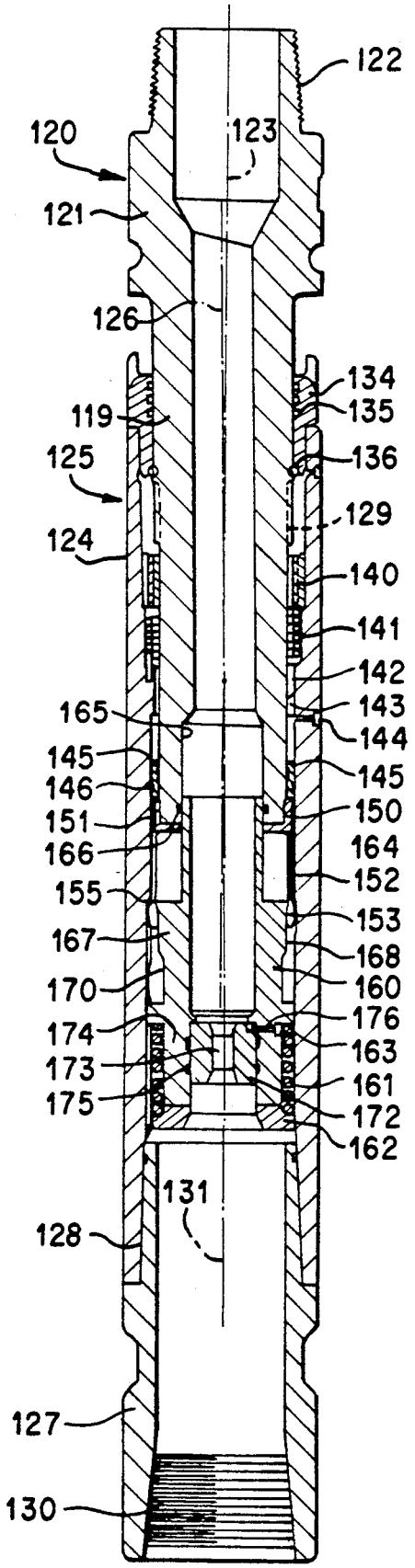
FIG. 9 is a longitudinal sectional view of an embodiment of the present invention used above a drilling motor and as a separate component part of the system.

An embodiment of the present invention that is useful as a "stand-alone" downhole adjustable bent sub, that is one that is not an integral part of the drilling motor housing is shown generally at 100 in FIG. 9. This apparatus can be connected in the drill string above the motor 15, rather than being incorporated in the housing of the motor as previously described. Here the mandrel 120 has an upper section 121 that is provided with a threaded pin 122 so that it can be connected to the lower end of a drill collar above the motor 15. The upper section 121 has a longitudinal centerline shown as a long-and-short dash line 123 that coincides with the central axis of the pipe. The lower section 119 of the mandrel 120 extends down into the upper section 124 of a tubular housing 125 on an axis shown as a dash line 126 that is inclined at a small angle with respect to the axis 123 of the mandrel section 121, such axis also being the centerline for most all of the machined surfaces inside the housing section 124. The box 127 that is threaded to the lower end of the housing 125 at 128 has internal threads 130 which enable it to be screwed onto the upper end of a collar therebelow, or to the upper end of the motor 15. The longitudinal centerline 131 of the box 127 is coincident with the centerline 123 of the upper section 121 of the mandrel 120 in the position of the parts shown in FIG. 10.

As employed in the previous embodiment, a cap 134 that is threaded to the upper end of the housing section 124 has seal rings 135 that prevent fluid leakage with respect to the mandrel 120. A retainer ring 136 limits upward movement of the mandrel 120 relative to the housing 125. As in the previous embodiment, the mandrel section 123 has upper splines 129 that can mesh with internal grooves in a stop ring 140 to cause the ring to rotate with it when the mandrel is lowered and then turned. A stop shoulder on the ring engages a rib on the housing at the end of 180° of rotation. When the splines 129 are withdrawn from the ring 140 in response to upward movement of the mandrel 120, a torque spring 141 automatically rotates the ring 140 back to its initial position. The structure, function and operation of the stop ring 140 and the return spring 141 are identical to those elements of the previous embodiment. Lower splines 142 on the mandrel section 119 mesh with spline grooves 143 on the housing 125 when the mandrel 120 is extended to prevent relative rotation, and become disengaged therefrom when the mandrel is moved downward to the retracted position.

The various internal spaces between the mandrel 120 and the housing 125 are filled with a suitable lubricating oil via a fill plug 144, and a movable piston ring 145 having inner and outer seals 145, 146 provides compensation for changes in pressure and temperature. A collet sleeve 150 that is threaded to the lower end of the mandrel 123 at 151 has a plurality of depending spring fingers 152 having enlarged heads 153. The outer portions of the heads 154 are received in an internal annular recess 155 in the upper position of the mandrel 120 as shown in FIG. 10.

A sleeve 160 is biased upward by a coil spring 161 which reacts between a retainer 162 and a downwardly facing shoulder 163 on the sleeve. The upper portion 164 of the sleeve 160 slides into a bore 165 on the mandrel section 123. A seal ring 166 prevent fluid leakage. An intermediate portion 167 of the sleeve 160 has an enlarged outer diameter that provides a locking surface 168 which engages the inner surfaces of the heads 163 when the sleeve is shifted relatively downward. So long as the surface 168 engages the heads 153, the mandrel 120 is locked against longitudinal movement relative to the housing 125. However when the sleeve 160 shifts upward relative to the collet 150, an external annular recess 170 below the locking surface 168 is positioned behind the heads 153 which allows the heads to resile inward and release from the recess 155, whereby the mandrel 120 is free to be moved downward and upward to a limited extent within the housing 125.

An annular orifice member 172 having a reduced diameter throat 173 is positioned within the lower portion 174 of the sleeve 160. Seal rings 175 prevent fluid leakage past the O.D. of the member 172, and a pin 176 or the like can be used to prevent rotation of the member relative to the lower sleeve portion 174. Suitable means also can be used, as in the previous embodiment, to key the sleeve 160 against relative rotation.

This embodiment of the present invention functions and operates in the same way as the earlier described embodiment, however the bent sub assembly 100 can be attached to the top of the motor 15, or at another location in the drill string above the motor. When it is desirable to change the course of the borehole, the mandrel 120 is lowered until the shoulder 177 abuts the top surface 178 of the housing cap, and then rotated one-half turn to the right. This causes the housing 125 to become skewed with respect to the upper section 121 of the mandrel 120 by a predetermined bend angle, which tilts the drilling motor 15 and the bit in such a way that the drilling of a curved borehole will result.

It now will be recognized that a new and improved bent sub apparatus has been provided which achieves the various objectives, and which has the various advantages and features of, the invention. Since certain changes or modifications may be made in the disclosed embodiment without departing from the inventive concepts involved, it is the aim of the appended claims to cover all such changes and modifications that fall within the true spirit and scope of the present invention.

What is claimed is:

1. Downhole adjustable apparatus for creating a bend angle in order to affect the inclination of a drilled borehole comprising: an upper tubular member having an upper portion and a lower portion, said upper portion having a longitudinal axis; a lower tubular member having an upper portion and a lower portion, said lower portion having a longitudinal axis that normally is coincident with the longitudinal axis of said upper portion of said upper tubular member, one of said portions being received within the other for relative rotational movement about an axis that is inclined with respect to the said longitudinal axes of said members, whereby in a first rotational position said longitudinal axes have one geometrical relationship, and in a second rotational position said longitudinal axes have a second, different geometrical relationship.

2. The apparatus of claim 1, wherein said portions are arranged for limited longitudinal movement between extended and retracted positions; and clutch means engaged in response to movement of said members to said extended position for preventing relative rotation thereof.

3. The apparatus of claim 2 further including means responsive to movement of said portions to said retracted position for releasing said clutch means and allowing relative rotational movement.

4. The apparatus of claim 3 further including stop means for positively stopping relative rotation of said portions in said second rotational position.

5. The apparatus of claim 2 further including latch means operable in said extended position for releasably locking said members in said extended position.

6. The apparatus of claim 5 further including pressure responsive means for preventing release of said latch means.

7. The apparatus of claim 4 wherein said second rotational position is substantially 180° from said first rotational position.

8. The apparatus of claim 2 wherein said clutch means comprises first spline and groove means on said tubular members adapted to engage in one of said longitudinal relative positions and to disengage in another longitudinal relative position.

9. The apparatus of claim 4 wherein said stop means comprises a ring mounted between said members and having internal spline means and an external stop surface; actuator spline means on said upper tubular member engageable with said internal spline means when said clutch means is disengaged to enable said ring to be rotated by said upper member; said external stop surface of said ring engaging a companion stop surface on said lower member when said upper member is rotated to said second rotational position.

10. The apparatus of claim 9 further including spring means for returning said ring to its initial position when said spline means on said upper member is disengaged from said internal spline means on said ring.

11. The apparatus of claim 6 wherein said latch means comprises a plurality of circumferentially spaced spring fingers coupled to said upper member and having enlarged head portions thereon; and internal annular recess means on said lower member adapted to receive said head portions.

12. The apparatus of claim 11 wherein said preventing means comprises a sleeve member movable relative to said lower member between upper and lower positions, said sleeve member having surface means operable in said lower position to lock said head portions in said recess means; and orifice means on said sleeve member for creating a pressure drop in response to downward flow of drilling fluids to shift said sleeve member to said lower position.

13. The apparatus of claim 12 further including spring means reacting between said lower member and said sleeve member for urging said sleeve member toward said upper position.

14. The apparatus of claim 1 wherein annular spaces are present between said lower and upper portions of said members, said spaces being filled with a lubricating oil; and floating piston means between said portions for compensating pressure and temperature changes.

15. A bent housing apparatus for use in directional drilling operations where a downhole fluid-operated motor is used to drive a rotary rock bit that is located below a bearing assembly, comprising; telescopically related mandrel and housing members, said mandrel member being adapted for connection to said motor and said housing member being connected to a bearing assembly; drive shaft means extending through said members for transmitting the rotary output of said motor to said bit, said mandrel member having an upper portion with a principle axis that is coincident with the longitudinal axis of said motor, and a lower portion having a secondary longitudinal axis that is inclined at an angle with respect to said principle longitudinal axis, said housing member having a lower portion with a principle longitudinal axis that is coincident with the said longitudinal axis of said upper portion of said mandrel, and a secondary longitudinal axis that is coincident with said secondary axis of said lower portion of said mandrel member; said mandrel member being movable longitudinally with respect to said housing member between an extended position and a retracted position, said mandrel member being rotatable with respect to said housing member between a first angular position and a second angular position that is substantially 180° from said first position; means responsive to movement of said mandrel member to said extended position for preventing rotation of said mandrel member relative to said housing member, said rotation preventing means being released by longitudinal movement of said mandrel member to said retracted position to enable rotation of said mandrel member to said second angular position where said principle axis of said lower portion of said housing member is inclined with respect to the principle longitudinal axis of said upper portion of said mandrel member and the longitudinal axis of said motor to provide a predetermined bend in said apparatus between said motor and said bearing assembly.

16. The apparatus of claim 15 wherein said rotation preventing means includes first splines on said mandrel member adapted to mesh with companion splines on said housing member; and means for preventing engagement of said splines except at said first and second angular positions.

17. The apparatus of claim 15 further including stop means for positively stopping relative rotation of said mandrel and housing members in said second angular position.

18. The apparatus of claim 17 wherein said stop means includes second splines on said mandrel member; and a stop ring positioned between said mandrel and housing members, said stop ring having internal spline grooves adapted to receive said second splines on said mandrel member when said mandrel member is moved to said retracted position, whereby stop ring rotates with said mandrel member; said stop ring having an external shoulder that is adapted to abut an internal shoulder on said housing member when said mandrel member and said stop ring have been rotated through a predetermined angle relative to said housing member.

19. The apparatus of claim 18 further including torsion spring means for automatically returning said stop ring to its initial rotational position when said mandrel member is moved upward to disengage said second splines therefrom and to engage said first splines with said companion splines.

20. The apparatus of claim 15 further including pressure operated means for locking said mandrel member in said extended position.

21. The apparatus of claim 20 wherein said pressure operated means includes a sleeve movable relatively along said housing member between an upper position and a lower position; orifice means on said sleeve number for creating a pressure drop in response to flow of fluid therethrough, said pressure drop producing a force that tends to shift said sleeve member toward said lower position; coengageable means on said mandrel and housing members for preventing longitudinal relative movement; and locking surface means of said sleeve member operable in said lower position for preventing disengagement of said coengageable means.

22. The apparatus of claim 21 further including spring means for returning said sleeve member to said upper position in the absence of a sufficient magnitude of pressure drop across said orifice means.

23. The apparatus of claim 21 wherein said orifice means has a throat with a longitudinal centerline, the said centerline of said throat being laterally offset with respect to said secondary longitudinal axis of said lower portion of said housing member and sized to accommodate face rotation of said drive shaft means.

24. A rotational movement control system for use in a well tool, comprising:

a mandrel member received in a housing member and movable between extended and retracted positions relative thereto, said members being relatively rotatable between a reference position and a stop position; releasable clutch means operable in said extended position for preventing relative rotation; and means response to movement of said members to said retracted position for releasing said clutch means to allow relative rotation of said mandrel member through a predetermined angle; and spring-biased rotational movement stop means engaged during retractive movement for limiting relative rotation of said members to a predetermined angle.

25. A control system for use in a well tool comprising: a mandrel member telescopically and rotatably received in a housing member and movable between an extended position and a retracted position; clutch means on said members engaged in one of said positions to prevent relative rotation and disengaged in the other of said positions to permit relative rotation; rotation stop means between said members having internal spline grooves and external stop shoulders, one of said stop shoulders engaging a first stop surface on said housing member in a first rotational position and the other of said stop shoulders engaging a second stop surface on said housing member in a second rotational position; external spline means on said mandrel member engageable with said internal spline grooves on said stop member in said retracted position to cause said stop means to rotate with said mandrel member until said other stop shoulder engages said second stop surface on said housing member; and means applying a turning force to said rotational stop means to normally maintain said one stop shoulder against said first stop surface when said clutch means is engaged to establish a reference rotational position, and to return said rotational stop means to said reference rotational position when said external spline means is disengaged from said internal spline grooves after rotation of said stop member with said mandrel member to said second rotational position.

26. The system of claim 25 wherein said external spline means and said clutch means are longitudinally spaced in a manner such that said when said spline means is engaged with said internal spline grooves in said rotation stop means, said clutch means is disengaged to allow relative rotation between said members.

27. A method of changing the direction of a well bore that is being drilled by a rotary bit which is driven by a downhole fluid-operated motor, comprising the steps of: connecting an adjustable bent assembly between the power section of said motor and said bit, said bent assembly including first and second members that can rotate relative to one another from a first angular position where the respective principal longitudinal axes of said members are coincident so that said members form a substantially straight assembly to a second angular position where said members establish a bend angle; drilling along a first path with said members releasably fixed in said first position; releasing said members and rotating one of said members relative to the other of said members to said second angular position where said bend angle is established; reengaging said members and then drilling along a second path with said members releasably fixed in said second position.

28. The method of claim 27 including the further steps of aligning a longitudinal axis of one of said members with the longitudinal axis of said motor in said first position; and inclining said axes relative to one another in said second position at a predetermined bend angle.

29. The method of claim 27 including the further step of locking said members together in response to flow of drilling fluids, said locking step being automatically obviated when the flow of said drilling fluid is stopped.

30. The method of claim 27 wherein a clutch is cooperable with said members to provide a driving connection therebetween, and including the further steps of moving one of said members longitudinally relative to the other of said members to disengage said clutch to enable said rotating step to occur; and reengaging said clutch in said second angular position.

31. The method of claim 30 including the further step of positively stopping relative rotation of said members at said second angular position.

32. A method of changing the direction of a downhole portion of a well bore that is being drilled by a bit which is driven by a fluid-operated motor in response to circulation of a drilling fluid by pumps at the surface, comprising the steps of; positioning an adjustable bent assembly between said motor and said bit, said bent assembly having a mandrel member telescopically received within a housing member for limited movement between an extended and a retracted position, said mandrel member having a first longitudinal axis that is coincident with the longitudinal axis of said motor and a second longitudinal axis that is inclined with respect to said first longitudinal axis, said housing member having a first longitudinal axis that is coaxial with said first axis of said mandrel member, and a second longitudinal axis that is coincident with said second longitudinal axis of said mandrel member; pumping drilling fluids into the well to operate said motor and cause said bit to drill along one path; locking said members in response to pump pressure; stopping the pump to unlock said members; moving said mandrel member to said retracted position; rotating said mandrel member through a predetermined angle relative to said housing member to thereby cause said first longitudinal axis of said housing member to be inclined relative to said first longitudinal axis of said mandrel member; raising said mandrel member to said extended position; restarting said pumps to operate said motor and said drill bit; and again locking said members to thereby cause said bit to drill along another path.

33. The method of claim 32 including the further steps of engaging a clutch on said members in said extended position to prevent relative rotation therebetween; and disengaging said clutch in said retracted position to enable said rotation to occur.

34. The method of claim 32 including the further steps of again stopping said pump and unlocking said members, rotating said mandrel member relative to said housing member in the same rotational direction back to its initial position to thereby realign said first longitudinal axis of said housing member with said first longitudinal axis of said mandrel member; restarting said pumps to operate said motor and said bit; and relocking said members against longitudinal relative movement.

* * * * *